US008677865B2

(12) United States Patent
Buchanan et al.

(10) Patent No.: US 8,677,865 B2
(45) **Date of Patent: *Mar. 25, 2014**

(54) HAND OPERATED GRIPPING TOOL

(76) Inventors: Nigel A. Buchanan, Fife (GB); Seamus Duffy, County Longford (IE)

( * ) Notice: Subject to any disclaimer, the term of this patent is extended or adjusted under 35 U.S.C. 154(b) by 0 days.

This patent is subject to a terminal disclaimer.

(21) Appl. No.: 13/155,850

(22) Filed: Jun. 8, 2011

(65) Prior Publication Data

US 2011/0232429 A1 Sep. 29, 2011

Related U.S. Application Data

(63) Continuation of application No. 12/281,548, filed as application No. PCT/GB2007/000745 on Mar. 5, 2007, now abandoned.

(30) Foreign Application Priority Data

Mar. 3, 2006 (IE) ..... 2006/0158

(51) Int. Cl.
*B25B 7/04* (2006.01)
*B25B 7/12* (2006.01)

(52) U.S. Cl.
USPC ..... 81/407; 81/355; 81/408

(58) Field of Classification Search
USPC ..... 81/352–356, 360–366, 373, 376, 81/378–380, 407, 408, 427, 427.5, 81/409–414
See application file for complete search history.

(56) References Cited

U.S. PATENT DOCUMENTS

| | | | | |
|---|---|---|---|---|
| 389,666 | A * | 9/1888 | Reagan | 81/408 |
| 1,106,518 | A | 8/1914 | Matti | |
| 1,508,510 | A | 9/1924 | Edwards | |
| 1,534,218 | A | 4/1925 | Jones | |

(Continued)

FOREIGN PATENT DOCUMENTS

| | | |
|---|---|---|
| DE | 871579 | 3/1953 |
| DE | 29816558 | 11/1997 |

(Continued)

OTHER PUBLICATIONS

International Search Report for corresponding PCT Applicaiton No. PCT/GB2007/000745, filed on Mar. 5, 2007.

(Continued)

*Primary Examiner* — Hadi Shakeri
(74) *Attorney, Agent, or Firm* — Gardner, Linn, Burkhart & Flory, LLP

(57) ABSTRACT

A hand operated gripping tool includes a movable jaw, a fixed jaw, a first cam associated with the movable jaw, a pivotal handle connected with the movable jaw and a second cam associated with the pivotal handle. The first cam is spaced from the fixed jaw by a first variable distance, and the second cam is spaced from the fixed jaw by a second variable distance, with the first distance maintained greater than the second distance. The jaws are cooperable to define a variable size space for receiving a workpiece and the cams are operable to cause the jaws to grip the workpiece positioned in the variable size space. The cams are arranged such that rotational movement of the second cam caused by operation of the pivotal handle causes the movable jaw to pivot on the first cam to grip the workpiece that is positioned in the variable size space.

19 Claims, 19 Drawing Sheets

(56) References Cited

U.S. PATENT DOCUMENTS

| | | | | |
|---|---|---|---|---|
| 1,867,912 | A | | 2/1931 | Evey |
| 2,595,368 | A | | 5/1952 | Plautz |
| 3,142,212 | A | | 7/1964 | Grape |
| 3,222,958 | A | | 12/1965 | Houdesheldt |
| 3,575,064 | A | | 4/1971 | Stevinson |
| 3,657,949 | A | | 4/1972 | Myers |
| 3,862,776 | A | | 1/1975 | Sims et al. |
| 4,893,530 | A | | 1/1990 | Warheit |
| 6,026,716 | A | | 2/2000 | Orlosky |
| 6,065,376 | A | * | 5/2000 | Khachatoorian ..... 81/407 |
| 6,116,124 | A | | 9/2000 | Ping |
| 7,313,989 | B1 | | 1/2008 | Tortolani, Jr. |
| 2009/0056510 | A1 | | 3/2009 | Buchanan et al. |
| 2009/0178518 | A1 | | 7/2009 | Duffy et al. |

FOREIGN PATENT DOCUMENTS

| | | |
|---|---|---|
| GB | 18585 | 0/1901 |
| GB | 844490 | 1/1958 |
| GB | 2072081 | 9/1981 |
| JP | 09001468 | 6/1995 |

OTHER PUBLICATIONS

Search Report for British Application Serial No. GB0908588.7, Jul. 27, 2009.

Search Report of British Application No. GB1007513.3, Sep. 23, 2010.

* cited by examiner

HAND OPERATED GRIPPING TOOL

CROSS-REFERENCE TO RELATED APPLICATION

The present application is a continuation of U.S. patent application Ser. No. 12/281,548, filed Sep. 3, 2008, which is a 371 application of PCT Application No. PCT/GB07/00745, filed Mar. 5, 2007, which claims priority to Irish Application No. IE 2006/0158, filed Mar. 3, 2006, which are hereby incorporated herein by reference in their entireties.

FIELD OF INVENTION

The invention relates to hand operated gripping tools and particularly to hand operated gripping tools that are adjustable to any size of workpiece within the range of the jaws of the tool. One form of hand operated gripping tool to which the invention is particularly applicable is pliers of the type generally referred to as Water Pump Pliers or Slip Joint Pliers.

BACKGROUND TO THE INVENTION

Existing Water Pump pliers have the common characteristic of jaws offset at an angle to the Plier handles and a pivot post, in the form of a bolt or rivet, mounted in the area rearward of the jaw on one of the handles and projecting through an elongated slot on the other handle. In such pliers, means for enabling selective spacing of the distance between the jaws is variously provided by spaced apart ridges or teeth along the inside long edge of the slot adapted for incremental selective binding engagement with the pivot post. Another well known method of providing distance adjustment between the jaws in such pliers is the provision of spaced apart arcuate ridges on the interfacing surfaces adjacent the pivot point. All such tools in order to be adjusted to the size of a particular workpiece to be gripped between the jaws, require a two handed operation when the handles are pulled apart to permit a sliding action of the pivot post along the slot to move the jaws to approximately the desired workpiece size.

Further types of pliers are adapted to slideably close upon a workpiece in response to manual closing of the handles and, in response to contact with the workpiece, automatically lock against further sliding action by engaging suitable teeth and thereby shift from a sliding to a pivoting mode whereby continued exertion of manual force on the handles increases the gripping action upon the workpiece.

This gripping action upon the workpiece is a function of the relationship between the length of the operating handles and the length of the jaws pivoting around the pivot post (typically in a ratio of around 5:1). Therefore a considerable portion of the torque applied to the operating handle or handles is required to grip the workpiece to be operated meaning the workpiece can seldom be operated by such a device if it is itself tight to operate. In certain circumstances it would be a considerable advantage if the pliers could be locked upon the workpiece. The existing designs are unable to include this function.

The pivot post locking action, whether by spaced apart ridges, teeth or arcuate ridges on the infacing surfaces, means that the jaws/handles are seldom in the optimum position prior to the shift from sliding to a pivoting mode which results in a variable gripping action upon the workpiece.

SUMMARY OF THE INVENTION

The invention provides a hand operated gripping tool comprising a first jaw, a second jaw, a first cam associated with said first jaw, a pivotal handle associated with said first jaw and a second cam associated with said pivotal handle, said first and second jaws being cooperable to define a variable size space for receiving a workpiece and said first and second cams being operable to cause said first and second jaws to grip a said workpiece that is positioned in said variable size space.

The invention also includes a hand operated gripping tool comprising a fixed handle, a fixed jaw and an elongate member extending between said fixed jaw and said fixed handle, a moveable jaw that is slideably supported on said elongate member and is operably connected with a first cam that engages a first clamp surface on said elongate member and a pivotal handle operatively connected with a second cam that engages a second clamp surface on said elongate member, wherein said first cam and said first clamp surface are arranged to cooperate with said second cam and said second clamp surface to cause said fixed and moveable jaws to grip a workpiece that is position in a space defined between the jaws in response to pivoting movement of said pivotal handle.

The invention also includes a hand operated gripping tool comprising first jaw means, second jaw means cooperable with said first jaw means to define an variable size workpiece receiving space, support means on which said first jaw means is slideable for varying the size of said workpiece receiving space and a pivotable lever means, said first jaw means and said pivotable lever means each being provided with engagement means for engaging respective parts on said support means such that pivoting movement of said lever means in one direction causes said first jaw means to move against a workpiece that is positioned in said workpiece receiving space at least substantially in contact with said first and second jaw means so as to grip said workpiece.

Embodiments of the invention provide a set of pliers for the rotational operation of fasteners, pipes/tubes and the like and especially for the operation of plumbing-type fittings. The pliers preferably include a locking function. Preferably, the locking function can be used to provide a 'vice grip' type clamping action which can be used for the purpose of gripping or clamping in a locking manner many differing shapes, materials or fasteners.

BRIEF DESCRIPTION OF THE DRAWINGS

Embodiments of hand operated gripping tools according to the invention will now be described by way of example only, with reference to the accompanying drawings in which.

DETAILED DESCRIPTION OF THE EMBODIMENTS

In the following description of the embodiments like parts of the hand operated gripping tool will be referred to by the same reference numbers.

Figure 1:
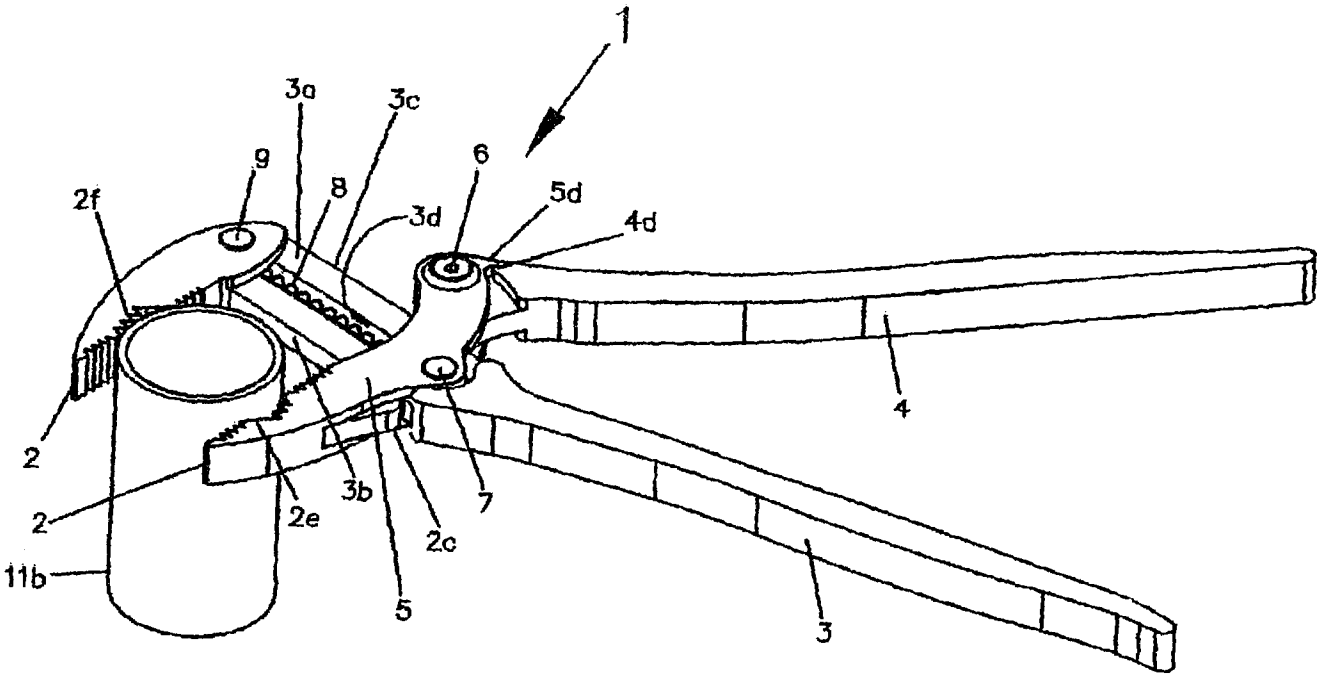
FIG. 1 is a perspective view of a first embodiment gripping a tubular workpiece.

FIG. 1 illustrates a first embodiment of a hand operated gripping tool in the form of pliers (1). The pliers (1) are in the fully open position with a tubular workpiece (11*b*) within the confines of the jaw portion (2) between the jaw gripping profiles (2*e*, 2*f*). The pivotal handle (4) is shown fully open from the fixed handle (3) with the pivotal handle stop (4*d*) abutting the linking arm stop (5*d*). The pivotal handle (4) is able to pivot around the handle pivot pin (6). The linking arm (5) pivots around the moveable jaw cam (2*c*), which acts against the inner clamp surface (3*b*) of an elongate bar (3*a*). A slide pivot pin (7) is capable of rotational movement and movement along a fixed handle elongate slot (3*d*) that is provided in the elongate bar (3*a*). A resilient member (extension spring) (8) fitted in the slot (3*d*) is retained at one end by the slide pin (7) and at the other end by the spring post (9).

Figure 2:
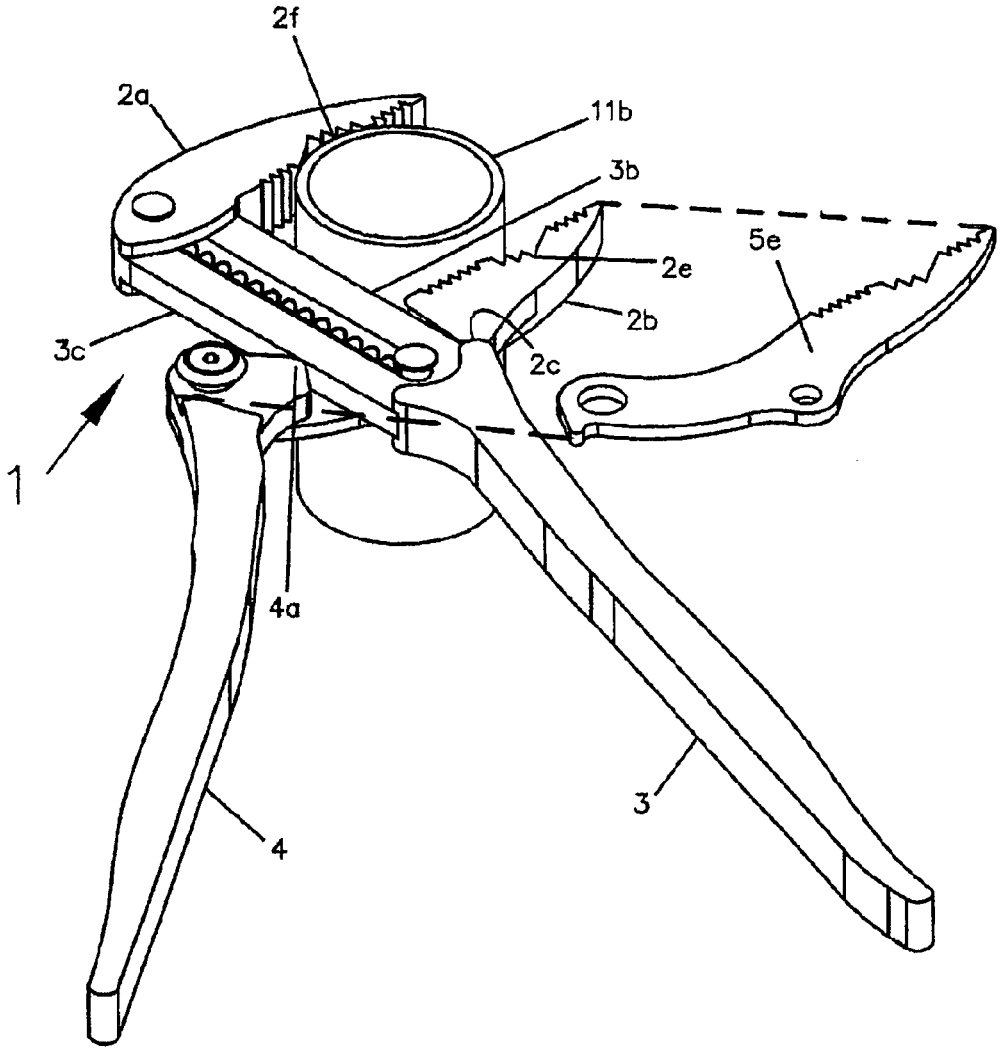
FIG. 2 is a perspective view of the first embodiment with the top lamination of the linking arm removed in order to reveal the internal mechanism.

FIG. 2 shows the first embodiment with a tubular workpiece (11*b*) between the fixed jaw gripping profile (2*f*) and the moveable jaw gripping profile (2*e*). The linking arm top laminate (5*e*) is shown removed in order to reveal the internal mechanism. The pivotal handle cam (4*a*) arranged to act on the outer clamp surface (3*c*) and the moveable jaw cam (2*c*) is arranged to act on the inner clamp surface (3*b*) when the pivotal handle (4) is rotated towards the fixed handle (3). In this embodiment, the clamp surfaces (3*b*, 3*c*) are disposed in parallel spaced apart relation.

Figure 3:
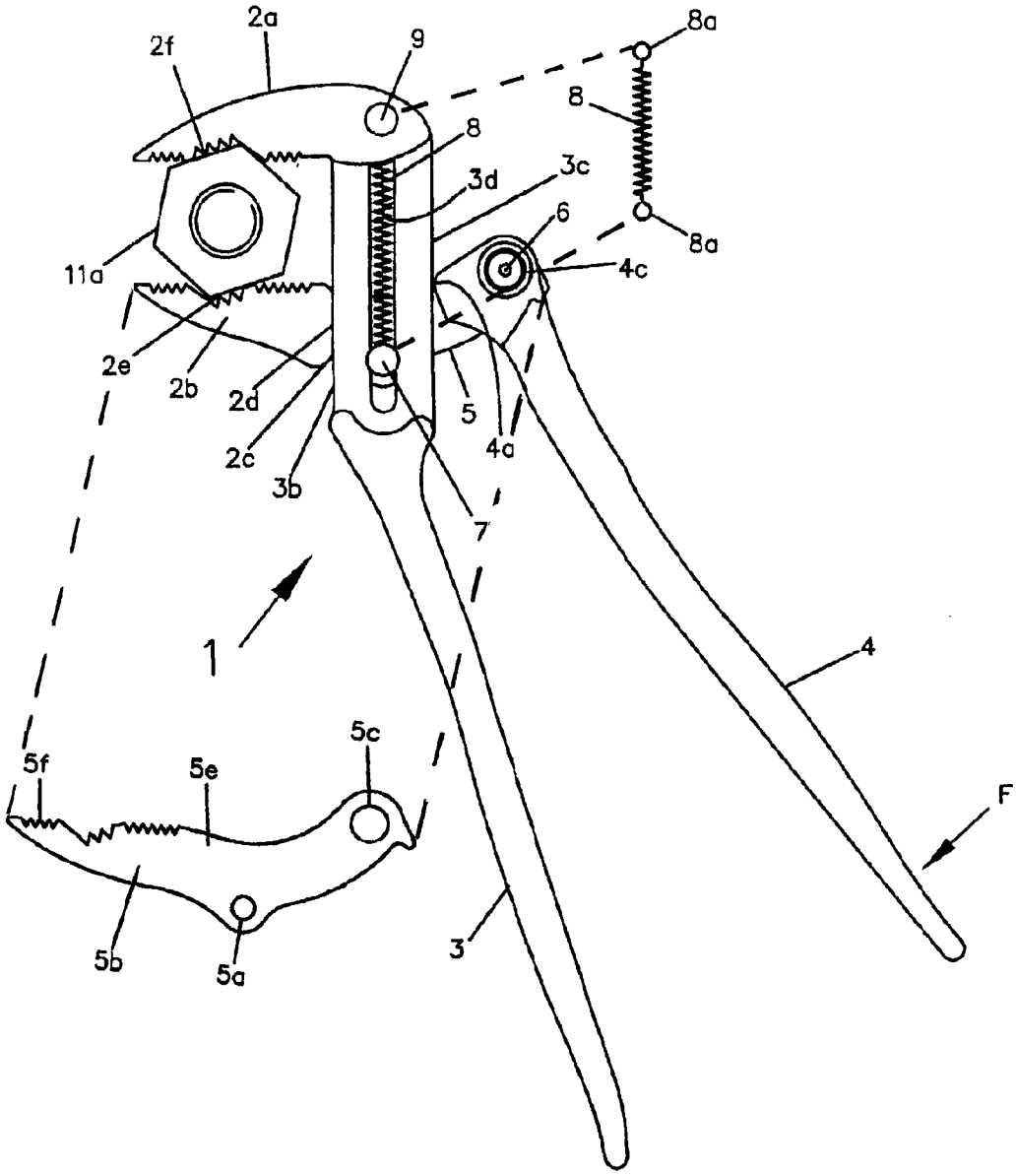
FIG. 3 is a plan view of the first embodiment gripping a fastener type workpiece with the top lamination of the linking arm is removed in order to reveal the internal mechanism.

FIG. 3 illustrates the first embodiment in plan view gripping a fastener (11*a*) between the fixed jaw gripping profile (2*f*) and the moveable jaw gripping profile (2*e*). For demonstration purposes the linking arm (5) top laminate (5*e*) is removed in order to show to the mechanism below. The handle pivot pin (6) is capable of pivotal movement within the linking arm pivot bushes (5*c*) and the pivotal handle bush (4*c*). The slide pin (7) is held within the linking arm slide pin bush (5*a*). The linking arm jaw portion (5*b*) has a similar gripping profile (5*f*) to that of the moveable jaw gripping profile (2*e*). The resilient member (8) resides within the elongate slot (3*d*) retained at the fixed end by the spring post (9) through its extension spring end loop (8*a*). The slide pin (7) retains the other end of the resilient member (8) by the other spring end loop (8*a*). The pivotal handle (4) is shown operated around the handle pivot pin (6) within the linking arm bushes (5*c*) and pivot handle bush (4*c*), such that the pivotal handle cam (4*a*) acts against the parallel outer clamp surface (3*c*) rotating the moveable jaw cam (2*c*) until the moveable jaw locking portion (2*d*) acts upon the parallel inner clamp surface (3*b*).

Figure 4:
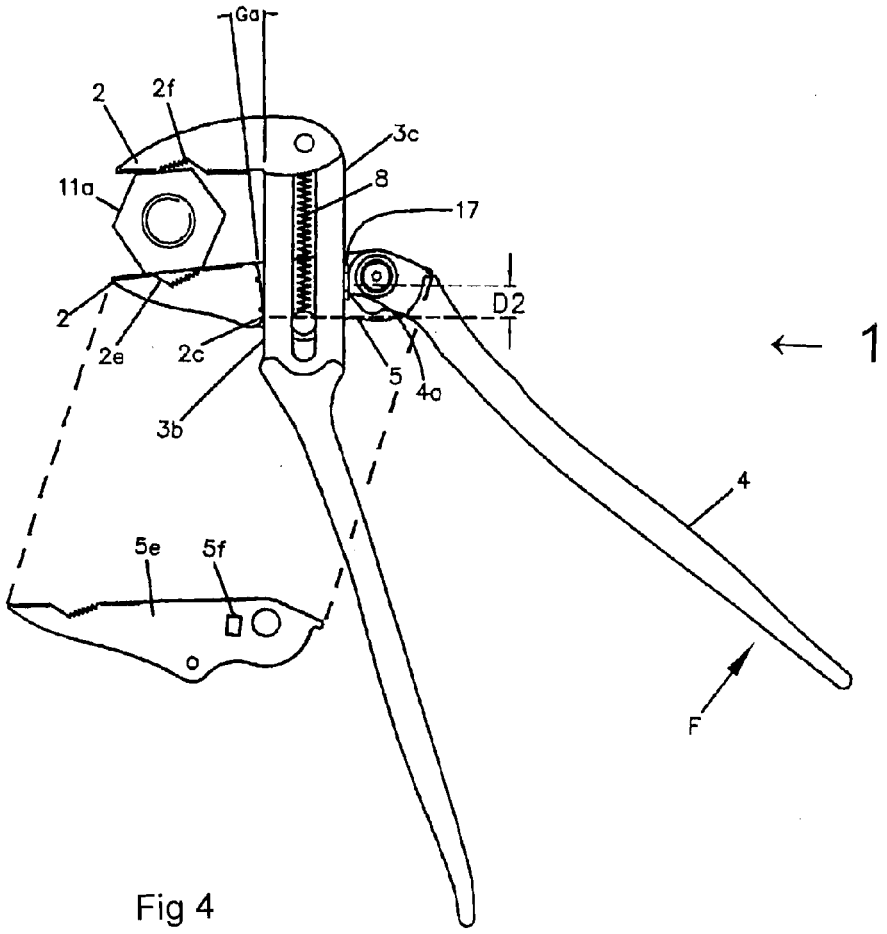
FIG. 4 is a plan view of a second embodiment in a relaxed open condition with the top lamination of the linking arm is removed in order to reveal the internal mechanism and a fastener loosely held between the jaws.
Figure 4A:
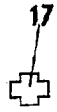
FIG. 4A is a plan view of the cruciform shaped shoe of the gripping tool of FIG. 4.

FIG. 4 illustrates the second embodiment of the pliers (1) with the linking arm (5) top laminate (5*e*) removed in order to show the internal mechanism. The pivotal handle (4) is fully opened allowing a gap between the pivotal handle cam (4*a*) and the parallel outer clamp surface (3*c*) and a further gap between the moveable jaw cam (2*c*) and the parallel inner clamp surface (3*b*). The fastener (11*a*) has only to overcome the tension of the resilient member (8) in order to rotate within the jaw portion (2) to allow the jaw gripping profiles (2*e*, 2*f*) to be usefully repositioned upon the fastener (11*a*). A slip shoe (17) is shown held between the cam (4*a*) and clamp surface (3*c*) by the slip shoe slot (5*f*). The distance between the cams (4*a*, 2*c*) is illustrated by (D2), which is the cam-to-cam distance. In the illustrated embodiment, and as shown in FIG. 4A. the slip shoe (17) has a cruciform shape.

Figure 5:
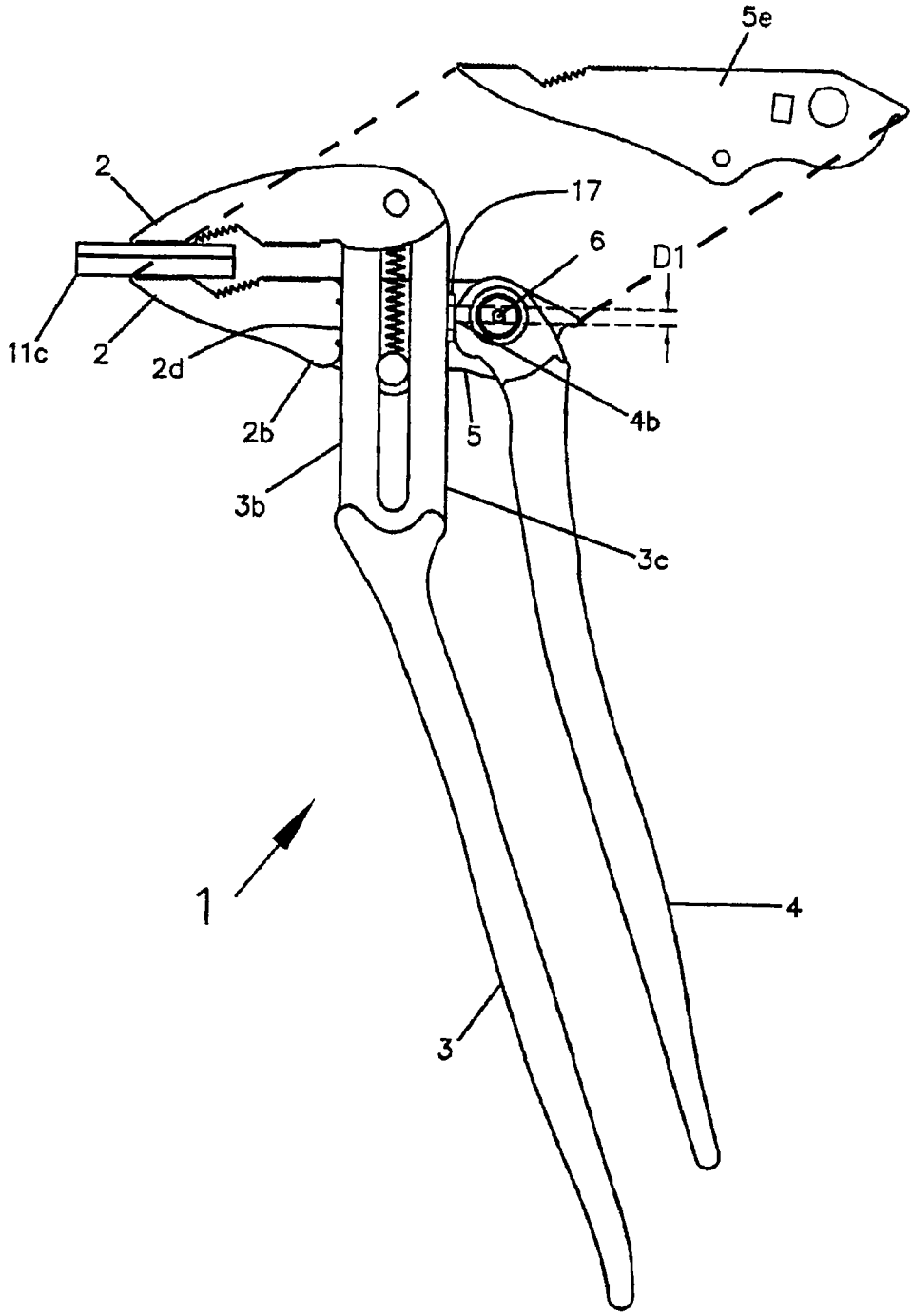
FIG. 5 is a plan view of the second embodiment in the locked position with the top lamination of the linking arm removed in order to reveal the internal mechanism.

FIG. 5 shows the second embodiment in plan view with the linking atm (5) top laminate (5*e*) removed to reveal the internal mechanism. The jaws (2*a*, 2*b*) are clamping two separate material laminations (11*c*) together. The pivotal handle (4) has been rotated until the locking portion (4*b*) has come into robust contact with the parallel outer clamp surface (3*c*) via the slip shoe (17). The moveable jaw (2*b*) locking portion (2*d*) is applied to the parallel inner clamp surface (3*b*) substantially above the centre of the handle pivot pin (6) (the cam lock distance (D1)) preventing the pivotal handle (4) from moving outwards with respect to the fixed handle (3) unless manually moved in that way. This locks the pliers (1) jaw portion (2) in the closed position upon the workpiece (11).

Figure 6:
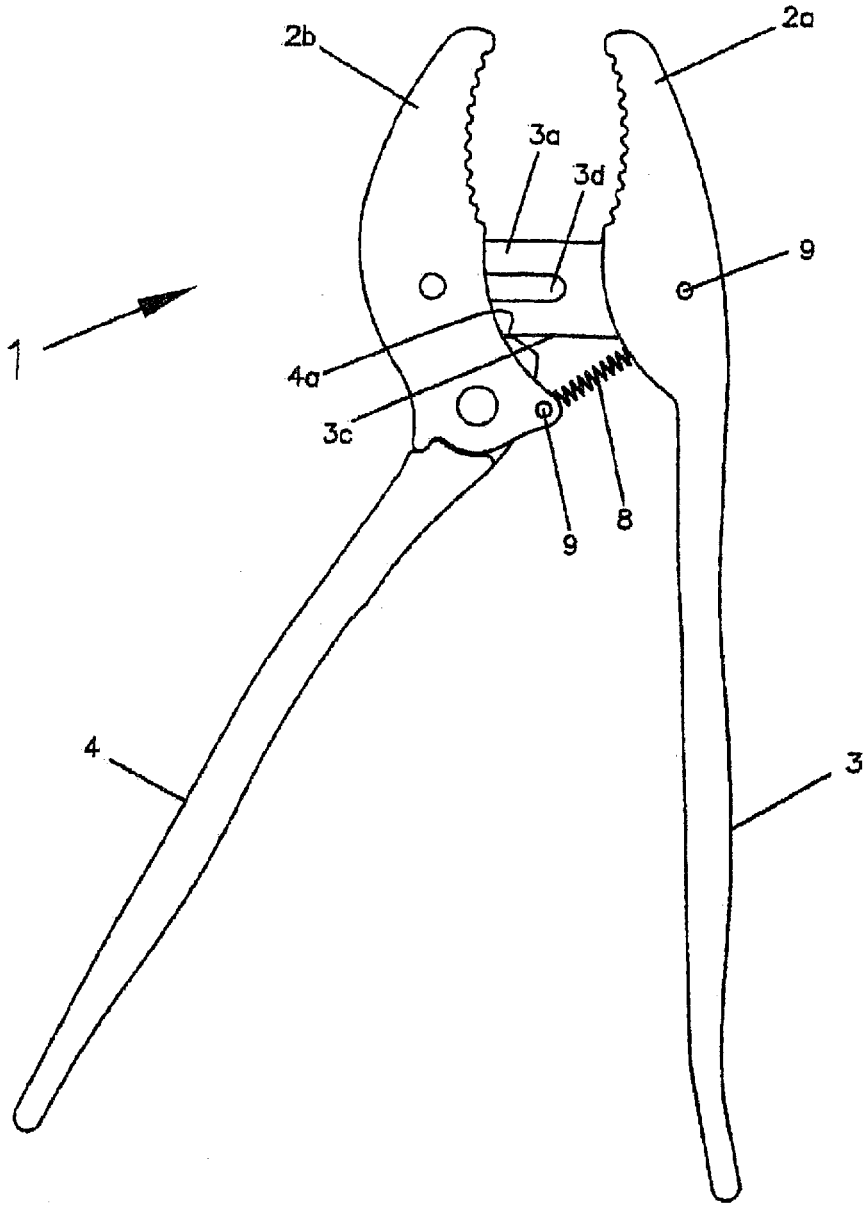
FIG. 6 is a plan view of a third embodiment in the open position with the top lamination of the linking arm removed in order to reveal the internal mechanism.

FIG. 6 is a plan view of the third embodiment of the pliers (1). The fixed handle (3) adjoins directly the fixed jaw (2*a*). The resilient member (8) is not within the elongate slot (3*d*). Instead, it is held between spring posts (9). The resilient member (8) is arranged to position at rest the pivotal handle cam (4*a*) against the outer clamp surface (3*c*). The pivotal handle (4) is illustrated operated against the resilient member (8) opening the gap between the fixed jaw (2*a*) and the moveable jaw (2*b*).

Figure 7:
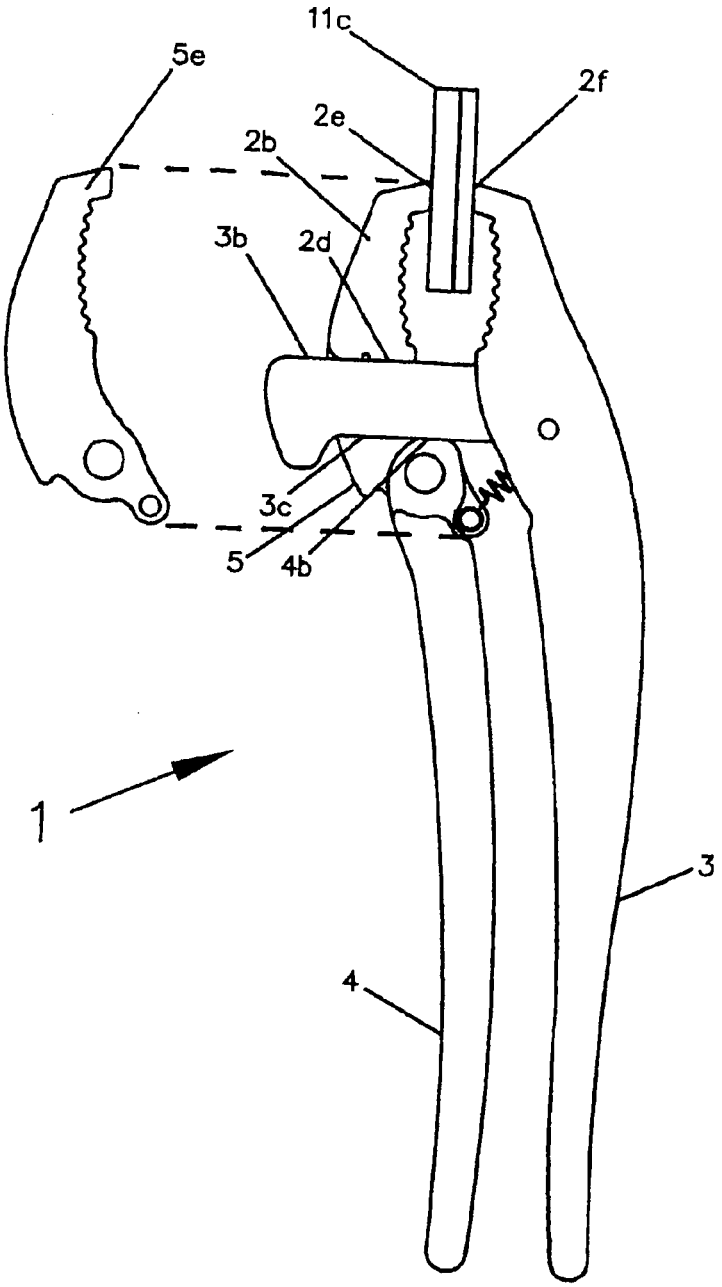
FIG. 7 is a plan view of the third embodiment fully operated with the jaws clamping and locking on a workpiece and with the top lamination of the linking arm removed in order to reveal the internal mechanism.

FIG. 7 shows the third embodiment of the pliers (1) with the linking arm (5) top laminate (5*e*) removed and with the jaw portion gripping profiles (2*e*, 2*f*) clamping together two material laminations (11*c*). The pivotal handle (4) is fully operated towards the fixed handle (3), resulting in a facet of the pivotal handle (4) locking portion (4*b*) coming into full contact with the parallel outer clamp surface (3*c*). The jaw portion gripping profiles (2*e*, 2*f*) are effectively locked on the laminate workpiece (11*c*).

Figure 8:
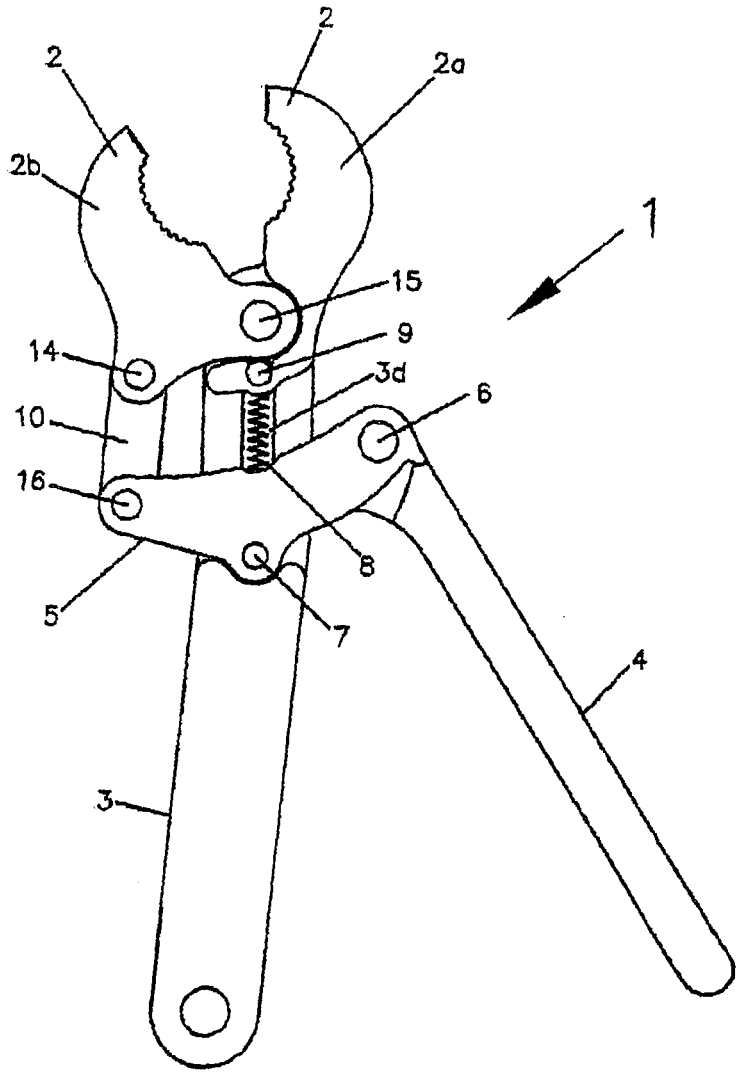
FIG. 8 is a perspective view of a fourth embodiment shown in the open position.

FIG. 8 illustrates in plan view the fourth embodiment of the pliers (1) utilising an additional linking arm (10) with pivot pins (14, 16). The pivotal handle (4) is in the open position and the linking arm (5) is operated away from the jaw portion (2) against the resilient member (8) which is retained within the elongate slot (3*d*). The resilient member (8) is held at the jaw portion end (2) by the spring post (9) and the fixed handle (3) end by the slide pin (7). The fixed jaw (2*a*) is shown fully open relative to the moveable jaw (2*b*). The moveable jaw (2*b*) swivels around the jaw pivot pin (15).

Figure 9:
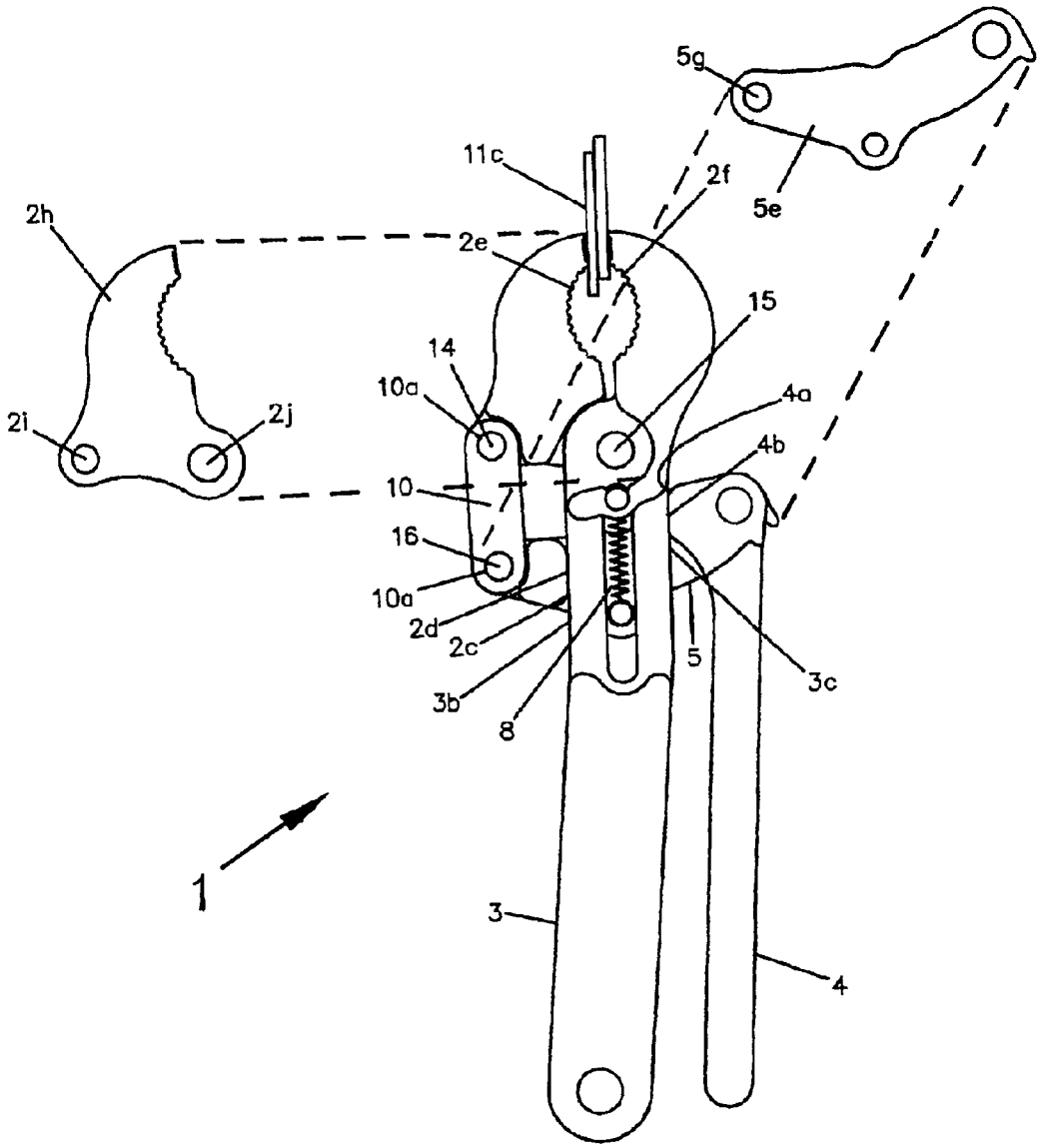
FIG. 9 is a plan view of the fourth embodiment with the jaws locked upon a laminate workpiece and with the top lamination of the linking arm is removed in order to show reveal the internal mechanism.

FIG. 9 shows in plan view the fourth embodiment of the pliers (1) operated and gripping a laminate workpiece (11*c*). For illustration purposes both the moveable jaw top laminate (2*h*) and the linking arm top laminate (5*e*) are shown removed. The resilient member (8) urges the linking arm (5) up the fixed handle (3) towards the jaw pivot pin (15). The jaw pivot pin (15) is rotatable within its bushes (2*j*). The urging of the resilient member pre-positions the jaw gripping profiles (2*e*, 2*f*) against the workpiece (11*c*). As the pivotal handle (4) is operated towards the fixed handle (3), the pivotal handle cam (4*a*) engages the outer clamp surface (3*c*). Further rotation brings a facet of the locking portion (4*b*) into engagement with the outer clamping surface (3*c*). This operation further rotates the moveable jaw cam (2*c*) against the inner clamp surface (3*b*) until its locking portion (2*d*) also acts upon the inner clamp surface (3*b*). This rotation further operate the additional linking arm (10) via its pins (14,16), which are rotatable within the bushes (10*a*, 2*i*, and 5*g*), causing the jaw gripping profiles (2*e*,2*f*) to act upon the workpiece (11*c*) in a gripping manner and remain locked until the pivotal handle (4) is manually moved away from the fixed handle (3).

Figure 10:
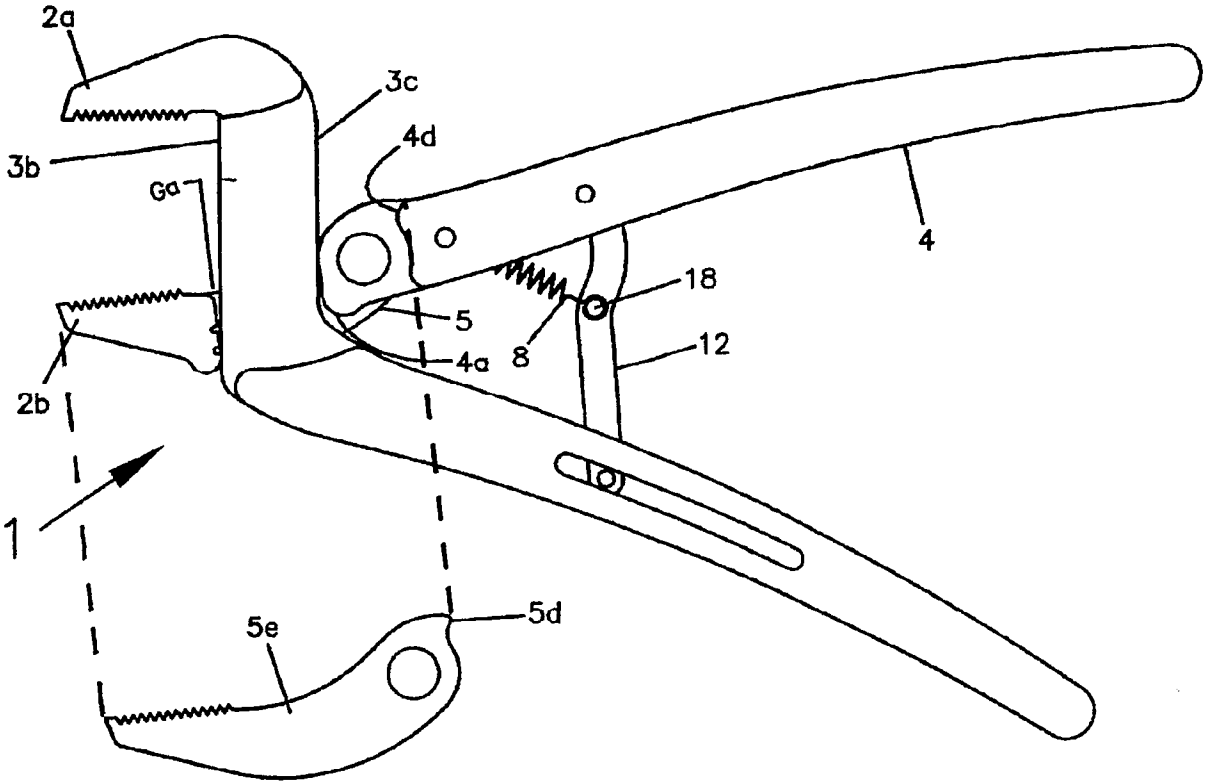
FIG. 10 is a plan view of a fifth embodiment incorporating a pivotal link and with the top lamination of the linking arm removed in order to reveal the internal mechanism.

FIG. 10 illustrates in plan view the fifth embodiment of the pliers (1). For demonstration purposes the linking arm (5) top laminate (5*e*) is shown removed. The pliers (1) are shown at rest. The resilient member (8) acts on the pivotal link (12) and pivotal handle (4) to urge the moveable jaw (2*b*) down the inner clamp surface (3*b*) away from the fixed jaw (2*a*). This opens the gripping angle (Ga). The pivotal handle stop (4*d*) acts against the linking arm stop (5*d*) to ensure this action. The pivotal handle cam (4*a*) is positioned such as to allow minimal grip upon the outer clamp surface (3*c*).

Figure 11:
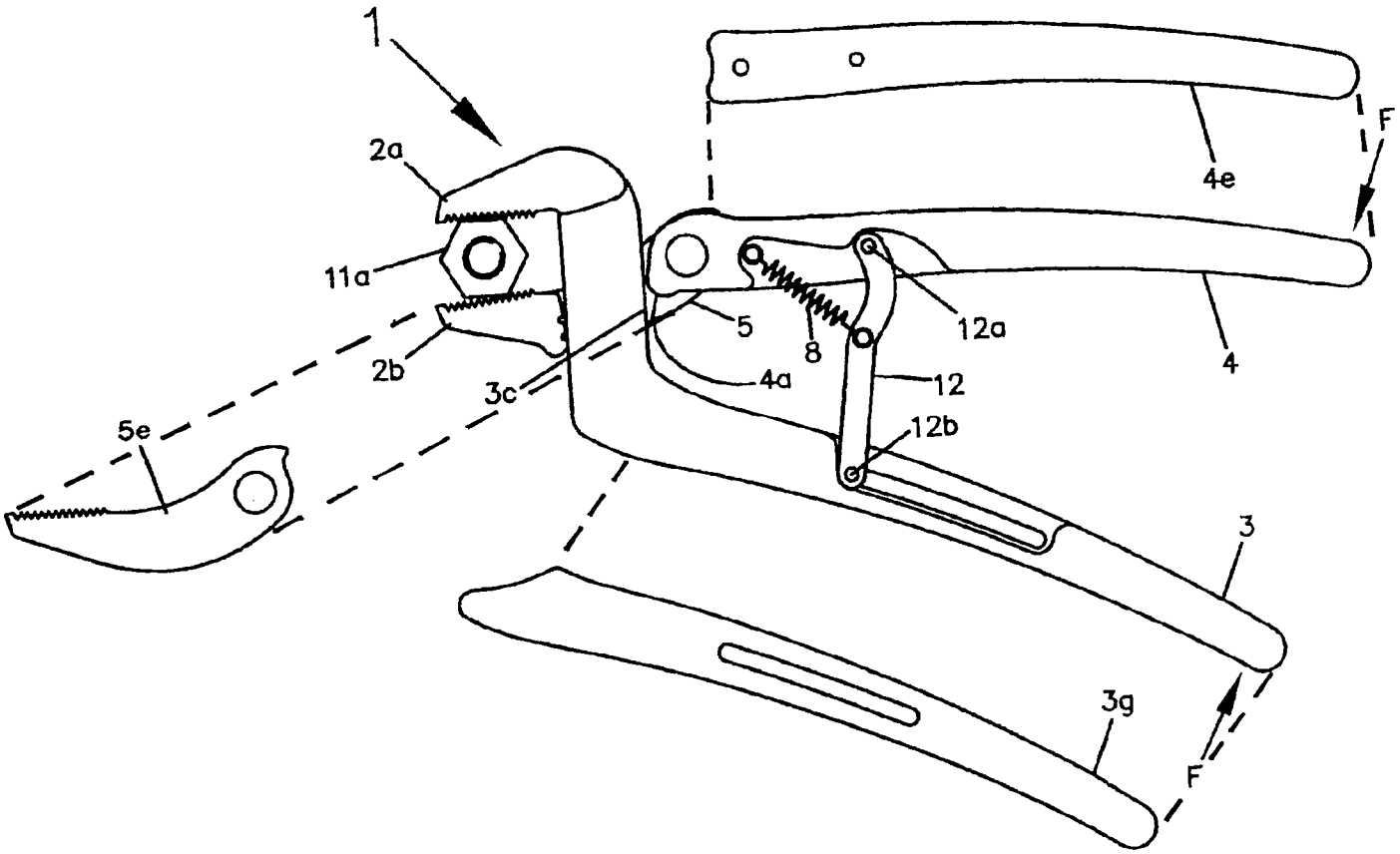
FIG. 11 is a plan view of the fifth embodiment with the top laminations of the linking, fixed and pivotal arms shown removed in order to reveal the internal mechanism and shown partially operated with the jaws coming against the workpiece.

FIG. 11 shows in plan view the fifth embodiment of the pliers (1) engaging a fastener 1 (11*a*). For illustration purposes the fixed handle top laminate (3*g*), pivotal handle top laminate (4*e*) and linking arm top laminate (5*e*) are shown removed. The pivotal handle (4) is shown operated towards the fixed handle (3) as force (F) is applied causing the pivotal handle to pivot around the pivotal link (12) and the pins (12*a*, 12*b*) against the effect of the resilient member (8) until the action is arrested by the jaws (2*a*, 2*b*) coming against the workpiece (11*a*). During this movement the engagement of the pivotal handle cam (4*a*) with the outer clamp surface (3*c*) causes no effective clamping action on the fastener (11*a*).

Figure 12:
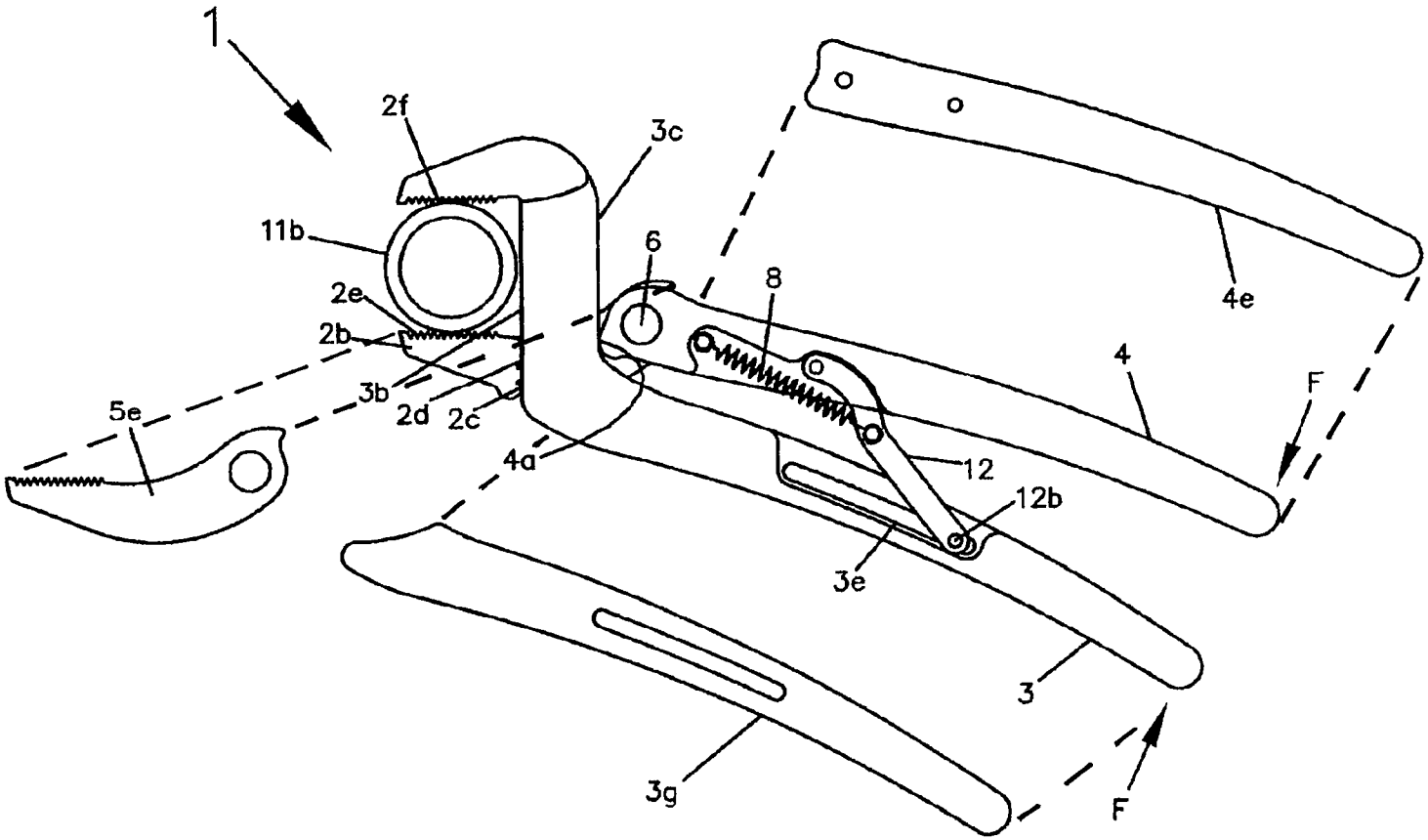
FIG. 12 is a plan view of the fifth embodiment corresponding to FIG. 11 but gripping a different type workpiece and in a different operating position.

FIG. 12 illustrates in plan view the fifth embodiment of the pliers (1) fully operated on a workpiece (11*b*). The top laminations (5*e*, 3*g*, 4*e*) have been removed in order to show the disposition of the various internal parts. The pivotal handle (4) is fully operated towards the fixed handle (3) and with the jaw gripping profiles (2*e*, 2*f*) engaging the workpiece (11*b*), the continued applied force (F) has caused the pivotal link (12) pin (12*b*) to travel down the sliding slot (3*e*), thereby extending the resilient member (8). This allows the pivotal handle (4) to rotate around the pivotal handle pin (6) causing the pivotal handle cam (4*a*) to act on the outer clamp surface (3*c*). This action rotates the moveable jaw (2*b*) around the moveable jaw cam (2*c*) propelling the locking portion (2*d*) towards the inner clamp surface (3*b*) further improving the gripping action of the jaw gripping profiles (2*e*, 2*f*) on the workpiece (11*b*). This allows considerable torque to be applied to the rotation of the workpiece (11*b*), whilst a reduced force (F) is required to ensure the jaw gripping profiles (2*e*,2*f*) remain adequately gripping the workpiece (11*b*).

Figure 13:
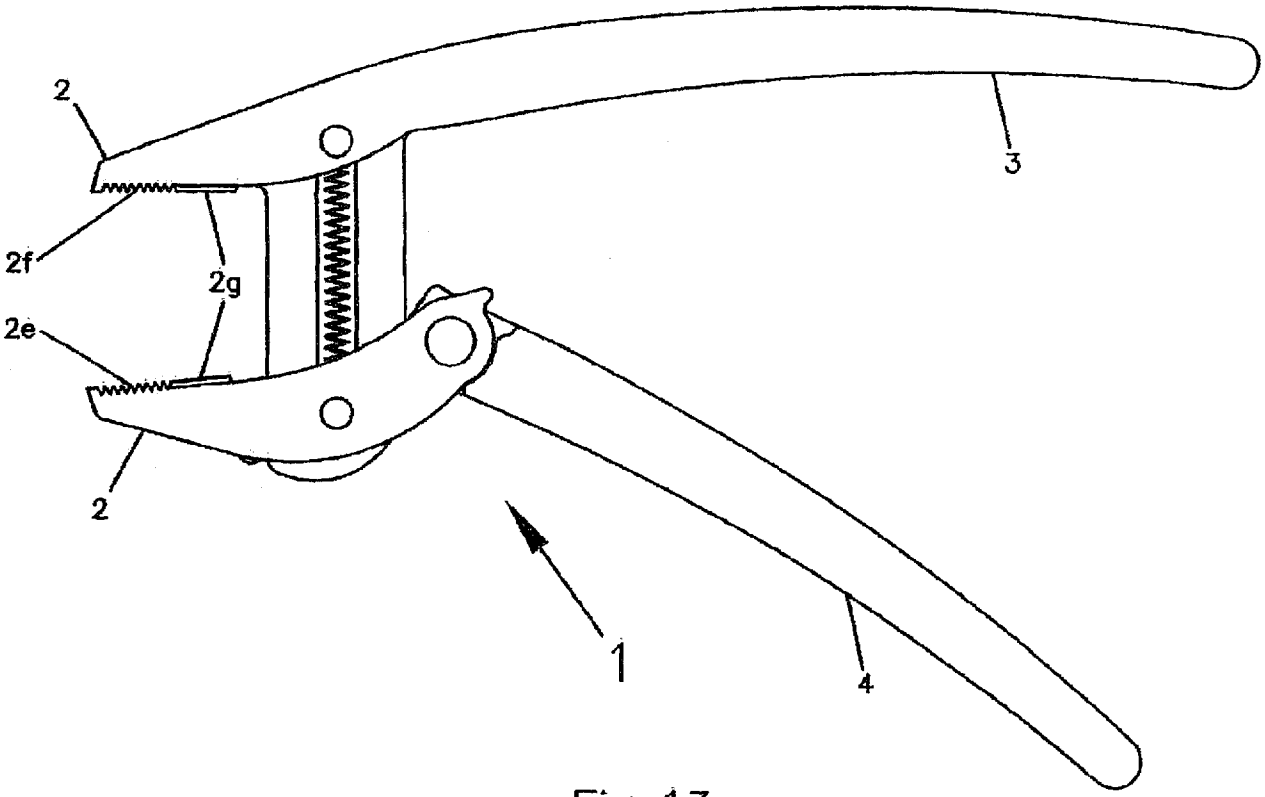
FIG. 13 is a plan view of a sixth embodiment incorporating cutters.

FIG. 13 shows in plan view a sixth embodiment of the pliers (1) having a set of cutters (2*g*) incorporated into the jaw gripping profiles (2*e*, 2*f*). When the handles (3, 4) are closed, the superior strength of the jaw portion (2) closure can usefully be used to cut, (or indeed with differing profiles be advantageously used to do such work as crimp cable terminals) that would normally require powered tools.

Figure 14:
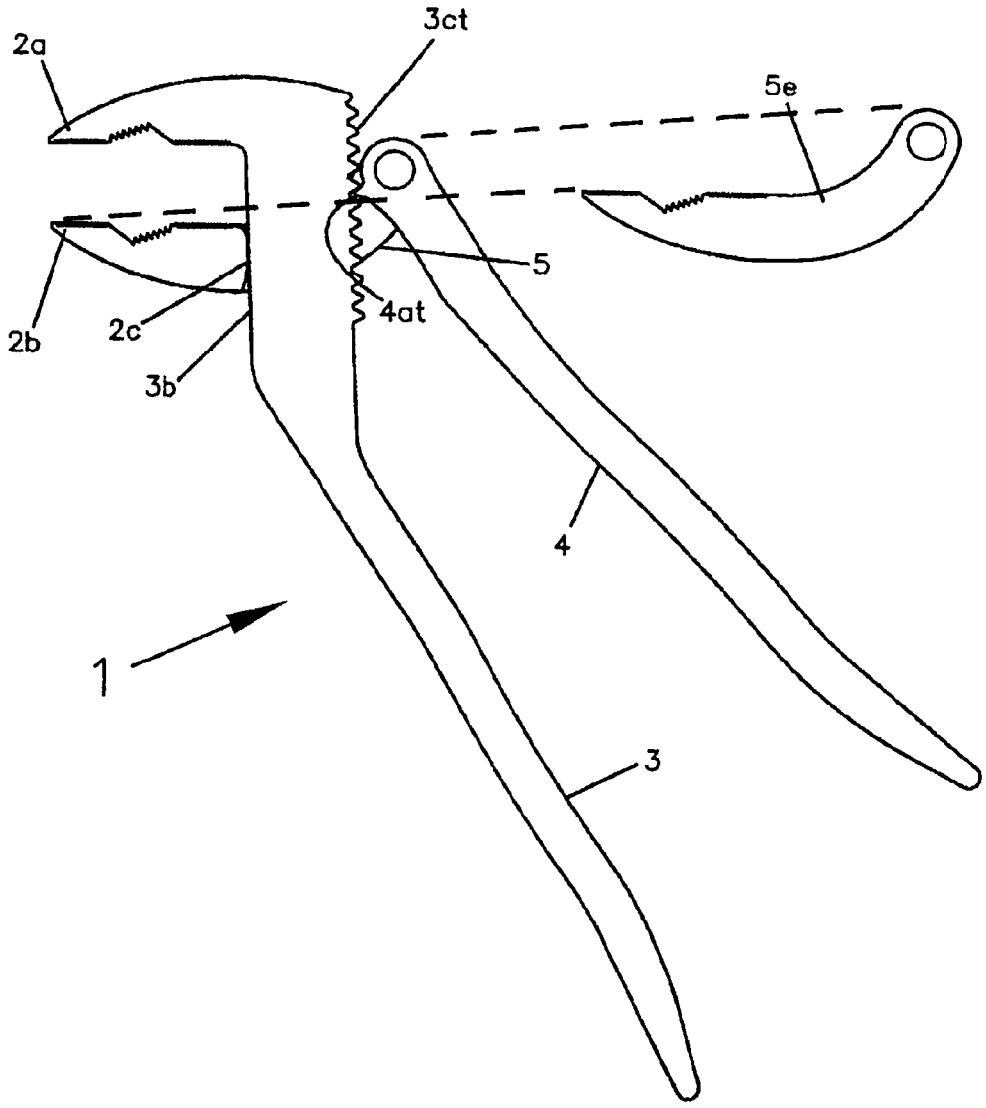
FIG. 14 is a plan view of seventh embodiment incorporating a toothed handle cam which interacts with a toothed clamp surface.

FIG. 14 illustrates in plan view a seventh embodiment of the pliers (1). The linking arm (5) top laminate (5*e*) is removed for demonstration purposes to illustrate the working mechanism below. The pivotal handle (4) incorporates a toothed cam (4 at) which interacts with a suitable toothed outer clamp surface (a*ct*) in order to close the fixed jaw (2*a*) and moveable jaw (2*b*), as the moveable jaw cam (2*c*) rotates against the inner clamp surface (3*b*).

Figure 15:
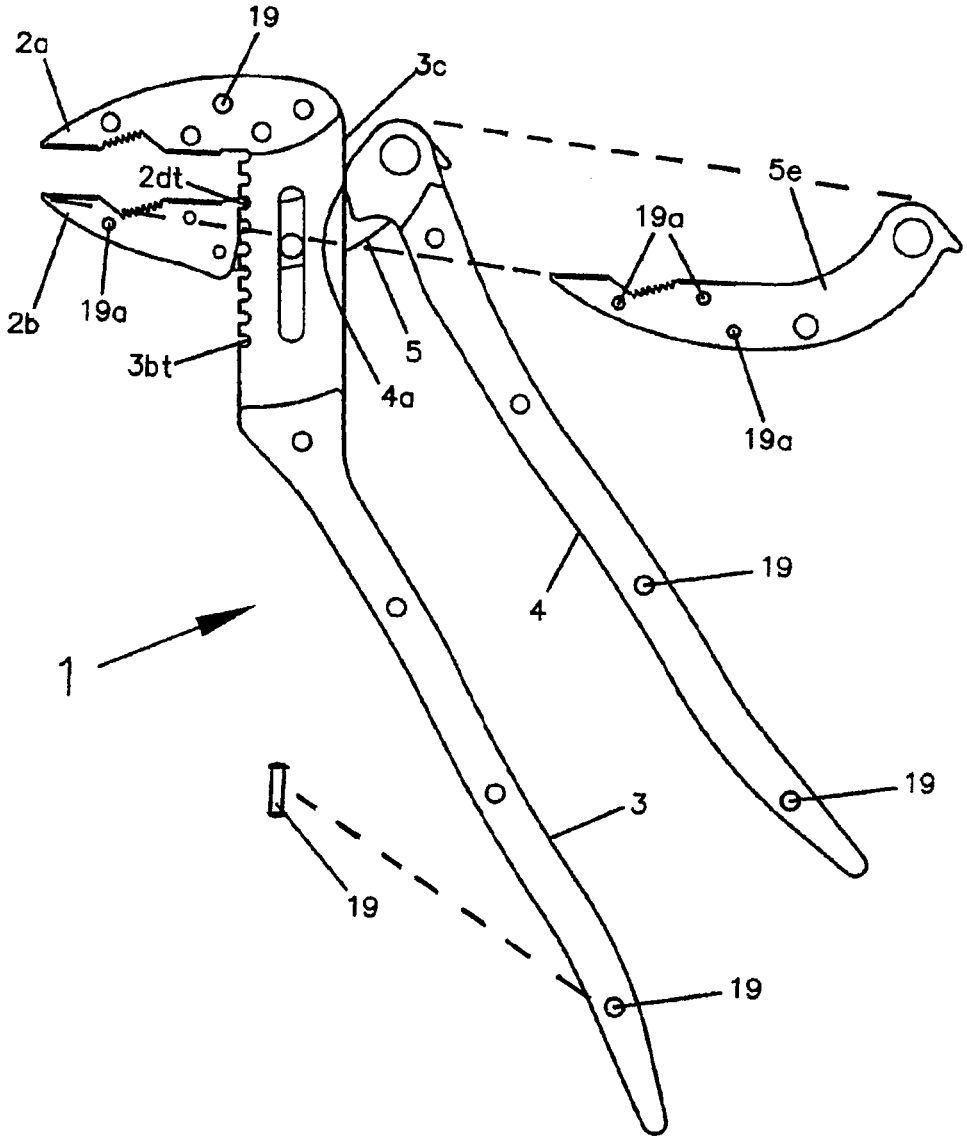
FIG. 15 is a plan view of an eighth embodiment incorporating a moveable jaw toothed cam which interacts with a toothed clamp surface.

FIG. 15 shows in plan view an eighth embodiment of the pliers (1). The linking arm (5) top laminate (5*e*) is removed in order to illustrate the internal mechanism. The moveable jaw (2*b*) incorporates a toothed cam (2*dt*) arranged such that when the pivotal handle (4) is operated towards the fixed handle (3) and the pivotal handle cam (4*a*) interacts with the outer clamp surface (3*c*), the moveable jaw (2*b*) rotates engaging the toothed cam (2*dt*) into the toothed inner clamp surface (3*bt*), thereby further closing the moveable jaw (2*b*) towards the fixed jaw (2*a*). Further illustrated is a known method of fixing various laminations together using rivets (19) through rivet holes (19*a*) within the laminations.

Figures 16A, 16B:
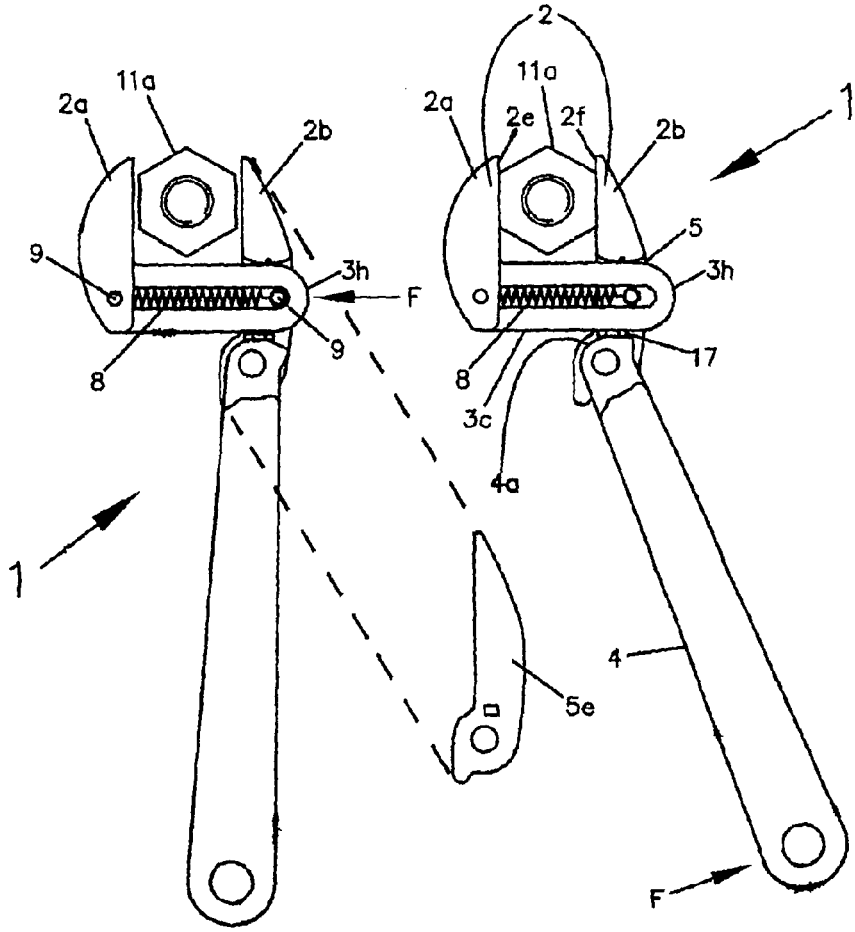
FIG. 16*a* is a plan view of a ninth embodiment shown opened to receive a fastener and with a lamination removed to reveal the internal mechanism.
FIG. 16*b* is plan view of the ninth embodiment corresponding to FIG. 16*a* but with the pivotal handle operated to lock the jaws on the fastener.

FIG. 16*a* and FIG. 16*b* illustrate in plan view a ninth embodiment of the pliers (1). The linking arm (5) top laminate (5*e*) is removed for demonstration purposes to illustrate the working mechanism below. In this embodiment, the fixed handle (3) is not required. As illustrated in FIG. 16*a* the jaw portion (2) is opened by applying force (F) to a fixed jaw extension member (3*h*), which acts upon the resilient member (8) held between spring posts (9). The force (F) moves the fixed jaw (2*a*) away from the moveable jaw (2*b*) in order to allow a suitably sized workpiece (11) to enter between the jaw gripping profiles (2*e*, 2*f*).

As shown in FIG. 16*b*, when the force (F) is removed from the jaw extension member (3*h*), the fixed jaw (2*a*) is propelled towards the moveable jaw (2*b*) until it abuts the workpiece (11*a*). Providing the resilient member (8) is sufficiently resilient to keep the jaw portion (2) closed upon the workpiece (11*a*), as the pivotal handle (4) has force (F) applied in the work direction, the pivotal handle cam (4*a*) acts through the slip shoe (17) upon the outer clamp surface (3*c*) rotating the linking arm (5) and further closing the jaw portion (2) jaw gripping profiles (2*e*, 2*f*) upon the workpiece (11*a*) allowing it to be worked.

In accordance with the embodiments shown in FIGS. 1 to 5, a fixed jaw (2*a*) is attached to a fixed handle (3) via an elongate bar (3*a*) and a moveable jaw (2*b*) is attached via a linking arm (5) (with appropriate clearances) to a pivotal handle (4) such that it can slide and pivotally lock relative to the fixed jaw (2*a*). Between the moveable jaw (2*b*) and the pivotal handle (4) there is an elongate bar (3*a*) with parallel clamp surfaces (3*b*, 3*c*). With the pivotal handle (4) in the open position, the moveable jaw (2*b*), linking arm (5) and pivotal handle (4) are free to slide to and fro upon the elongate bar (3*a*). There is preferably an elongate slot (3*d*) within the bar (3*a*), which preferably contains an extension spring (8) retained at one end by a slide pin (7) attached to the linking arm (5) between the moveable jaw (2*b*) and pivotal handle (4) and further retained by the spring post (9) attached to the fixed jaw (2*a*). The extension spring (8) acts to urge the two jaws (2*a*, 2*b*) towards a closed position when the pivotal handle (4) is in the open position. The moveable jaw (2*b*) and moveable jaw cam (2*c*), pivotal handle (4) and pivotal handle cam (4*a*) plus linking arm (5) have appropriate clearances to allow sliding movement upon the elongate bar (3*a*). To open the pliers jaw portion (2), the pivotal handle (4) is manually moved away from the fixed handle (3) and propelled down the elongate bar (3*a*) extending the spring (8) and opening the jaw portion (2) sufficiently to allow the workpiece (11) to enter between the jaw gripping profiles (2*e*, 2*f*). Manual de-activation of the pivotal handle (4) allows the spring (8) to close the jaws (2*a*, 2*b*) on the workpiece (11). The moveable jaw (2*b*) is now suitably positioned with the gripping profile (2*e*) abutting the workpiece (11). Manual activation of the pivotal handle (4) towards the fixed handle (3) brings the pivotal handle cam (4*a*) into contact with the outer clamp surface (3*c*) further propelling the moveable jaw cam (2*c*) against the inner clamp surface (3*b*). The pivotal handle cam locking portion (4*d*) is positioned substantially above the moveable jaw cam (2*c*) (i.e., nearer to the fixed jaw (2*a*)). The grip between the jaw portion gripping profiles (2*e*, 2*f*) and the workpiece (11) is increased as the pivotal handle cam (4*a*) is operated and the moveable jaw (2*b*) rotates inwardly around the moveable jaw cam (2*c*) until the moveable jaw locking portion (2*d*) comes into contact with the inner clamp surface (3*b*). Providing the pivotal handle cam (4*a*) is suitably proportioned and has sufficient force exerted upon it by the actuation of the pivotal handle (4) towards the fixed handle (3), the workpiece (11) will be firmly gripped within the jaw portion (2). The amount of clamping action between the workpiece (11) and the jaw gripping profiles (2*e*, 2*f*) is in direct relationship to the gripping action angle (Ga) (or moveable jaw (2*b*) rotation around the moveable jaw cam (2*c*) until the locking portion (2*d*) is clamped against the outer clamp surface (3*b*)). In use, operation of the workpiece (11) can result in additional force being exerted outwardly upon the jaw portion (2). This force is a result of the geometry between the moveable jaw (2*b*), moveable jaw cam (2*c*), locking portion (2*d*), the pivotal handle cam (4*a*) and the locking portion (4*b*) and will correspondingly increase the clamping action upon the parallel clamp surfaces (3*b*, 3*c*) of the elongate bar (3*a*). Therefore in operation, dependant on the torque required to operate the fastener, the gripping force is increased compared with that of prior art devices. Given appropriate handle (3, 4), jaw (2) and cam (2*c*, 4*a*) proportions, a ratio of over 12:1 handle to jaw closure leverage is achievable. The workpiece (11) can be manually operated by the operation of the pivotal handle (4) only. Advantageously, the gripping function can be released by reversing the operating direction of the pivotal handle (4) away from the fixed handle (3), thereby reducing the jaw portion (2) grip upon the workpiece (11) to approximately that of the extension spring (8) such that the workpiece (11) can conveniently be repositioned within the jaw gripping profiles (2*e*, 2*f*). In the gripping and operating function, the grip upon the workpiece (11) can be increased by manually increasing the force (F) applied between the pivotal and fixed handles (3, 4). A further locking function can be usefully incorporated by the provision of a locking portion or portions (4*b*) adjacent to the pivotal handle cam (4*a*), such that given suitable proportions and tolerances the pivotal handle (4) when robustly operated can move pivotal handle cam (4*a*) past the outer clamp surface (3*c*) to bring a (preferably flat locking portion or portions (4*b*)) into engagement with the clamping surface. Providing the flattish surface of the locking portion (4*b*) abuts the adjacent clamp surface (3*c*) suitably past a point equivalent to a right angle from the clamp surface (3*c*) through the centre point of the handle pivot pin (6) (the cam lock distance (D1)), the jaws (2*a*, 2*b*) will remain locked on the workpiece (11) until the pivotal handle (4) is manually operated away from the fixed handle (3). In some embodiments, in order to minimize the overall size of the pliers (1), the layout of the handles (3, 4) is reversed, resulting in the action of the pivotal handle cam (4*a*) upon the outer clamp surface (3*c*) possibly causing the jaws (2) to partially release their grip upon the workpiece (11). To overcome this potential problem, a slip shoe (17) can be provided. The slip shoe (17) is preferably retained within a slot (50 in the linking arm (5) to ensure it is correctly positioned between the pivotal handle cam (4*a*) and the outer clamp surface (3*c*). In use the pivotal handle cam (4*a*) now conveniently slips on the smooth surface of the slip shoe (17).

In order to substantially increase the gripping action angle (Ga), the embodiment shown in FIGS. 8 and 9 employs an additional linking arm (10). The distance from the moveable jaw cam (2*c*) to the additional linking arm pin (16) and the distance from the moveable jaw (2*b*) to the jaw pivot pin (16) directly governs the amount of grip applied to the workpiece (11).

The embodiment shown in FIGS. 10 to 12 incorporates a pivotal link (12) resiliently held in a near vertical position between the fixed (3) and pivotal handle (4). The resilient member (8) urges the jaw portion (2) open when at rest. Initial operation of the handles (3, 4) results in the pivotal handle (4) pivoting around the pin (12*a*), rapidly closing the jaw portion (2) upon the workpiece (11) until the jaws (2*a*, 2*b*) abut the workpiece (11) arresting any further travel of the moveable jaw (2*b*). Continued operation of the pivotal handle (4) forces the moveable end of the pivotal link (12) and pin (12*b*) along the sliding slot (3*e*) against the resilient member (8) allowing the pivotal handle (4) to further rotate around the pivotal handle pivot pin (6). This allows the pivotal handle cam (4*a*) to act on the parallel outer clamp surface (3*c*). The moveable jaw (2*b*) can now pivot around the moveable jaw cam (2*c*), further closing the jaw portion (2) upon the workpiece (11) and ensuring the workpiece (11) is suitably gripped prior to its operation.

The geometrical proportions of the pliers (1) can be varied to suit many different applications and gripping forces. FIG. 13 illustrates a jaw portion (2) incorporating a cutting profile (2*g*), although the superior clamping action of the jaws (2*a*, 2*b*) is suitable for many differing profiles and uses (for example crimping).

FIG. 14 shows an embodiment with a toothed pivotal handle cam (oat) that interacts with a suitably profiled toothed outer clamp surface (3*ct*) such that the moveable jaw earn (2*c*) requires no adjoining locking portion (2*d*).

FIG. 15 illustrates an embodiment arranged such that when the pivotal handle (4) is propelled towards the fixed handle (3) and the pivotal handle cam (4*a*) operates against the outer clamp surface (3*c*), the moveable jaw (2*b*) rotates around the moveable jaw cam (2*c*) and the toothed portion (2*dt*) of the cam engages into the adjacent suitably toothed clamp surface (3*bt*) and the moveable jaw (2*b*) rotates in an ever gripping way upon the gripped workpiece (11) until the pivotal handle (4) is either released or has reached the end of its travel.

As shown in FIG. 16*a* and FIG. 16*b*, a fixed handle (3) is not necessarily required, providing the resilient member (8) is resilient enough to ensure closure of the jaw portion (2) upon the workpiece (11) during the initial actuation of the pivotal handle (4) until the pivotal handle cam (4*a*) has sufficient grip on the outer clamp surface (3*c*) to allow the linking arm (5) to rotate around the moveable jaw cam (2*c*) closing the jaw gripping profiles (2*e*, 2*f*) on the workpiece (11).

Figure 17:
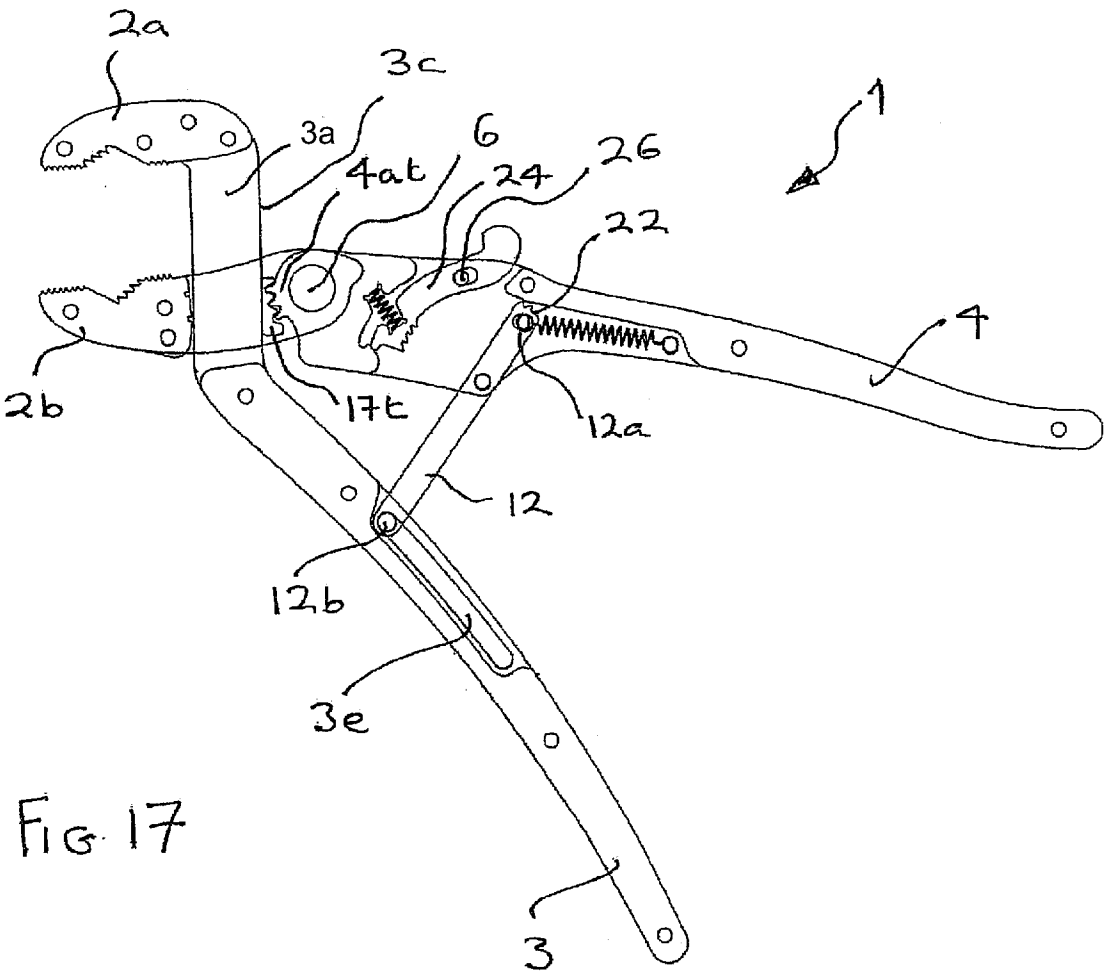
FIG. 17 is a plan view of the tenth embodiment with certain laminations removed and an automatic locking device in an operative unlocked condition.
Figure 18:
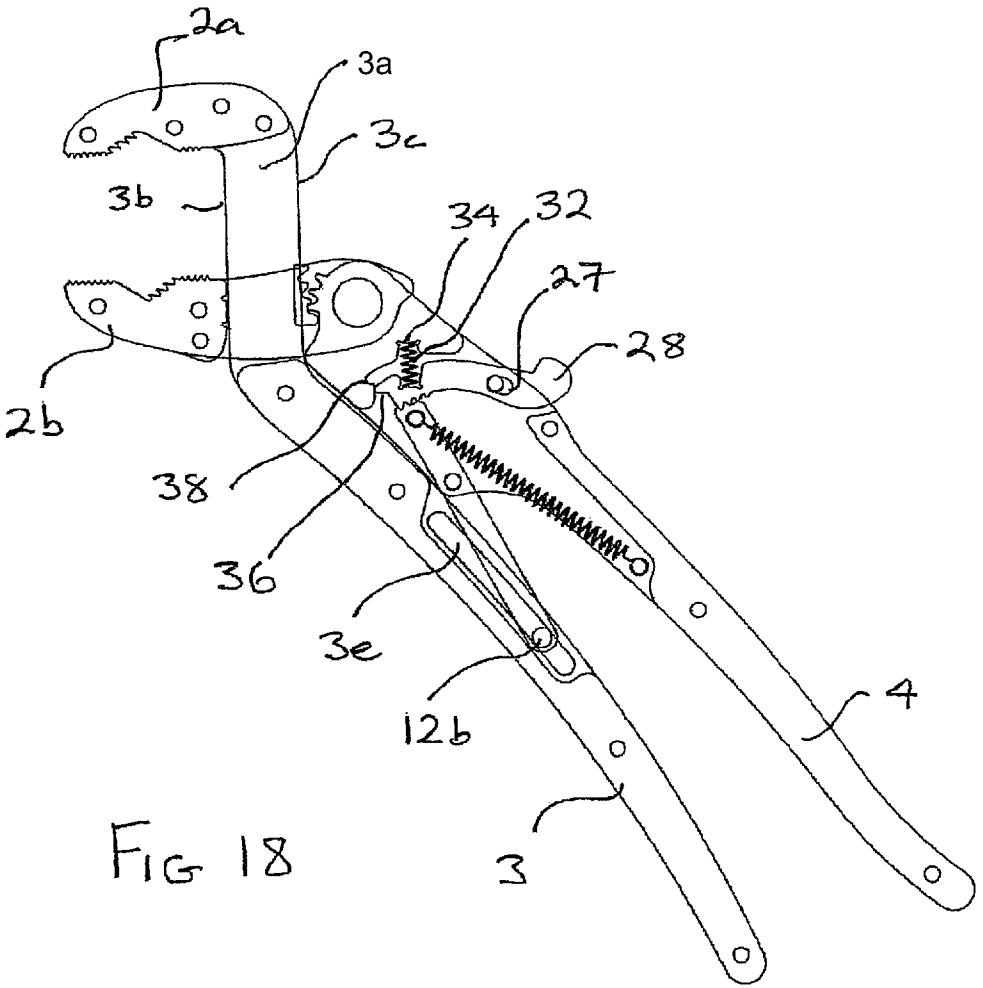
FIG. 18 is a plan view of the tenth embodiment with certain laminations removed and the automatic locking device in a locking condition.
Figure 19:
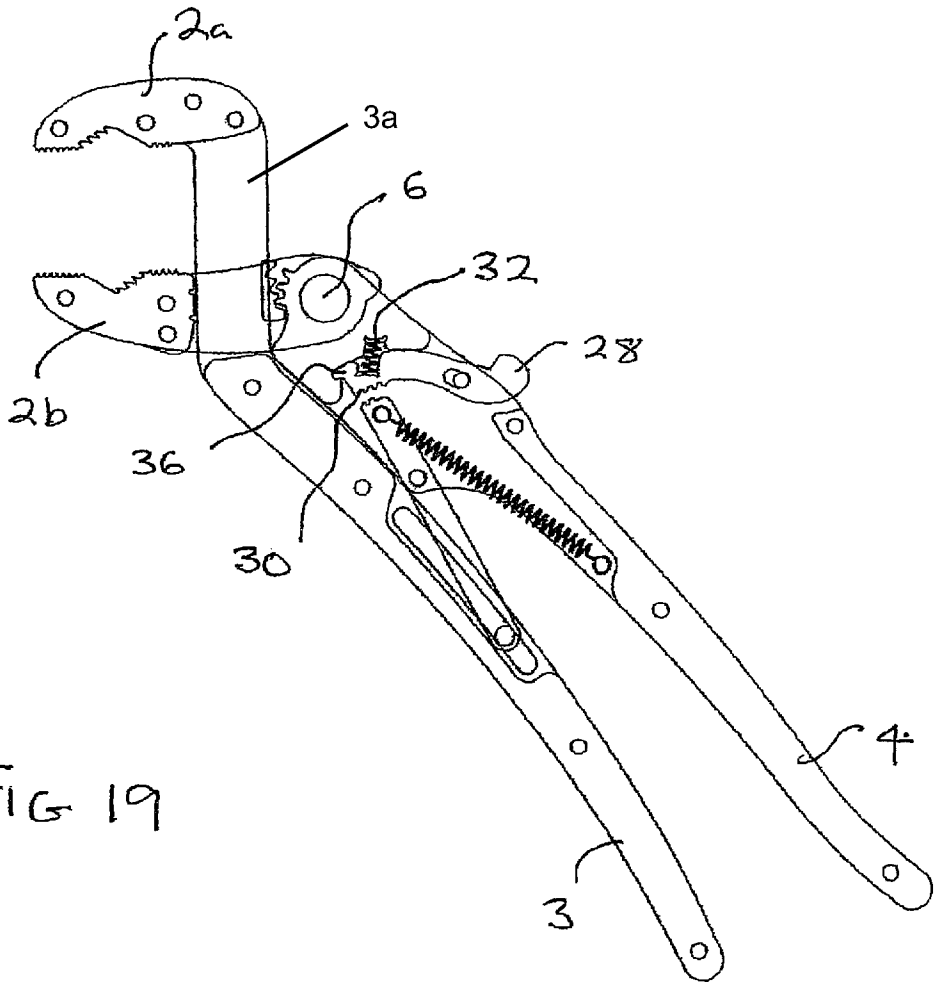
FIG. 19 is a plan view of the tenth embodiment with certain laminations removed and the automatic locking device in withdrawn non-operative condition.

FIGS. 17 to 19 illustrate a tenth embodiment of the pliers (1). As with the previous embodiments, certain laminations of the pliers 1 are shown removed to reveal the internal mechanism.

The pliers 1 of the tenth embodiment are similar to the pliers of the fifth embodiment that is illustrated in FIGS. 10 to 12. To avoid unnecessary repetition of description, only the parts different to those of the fifth embodiment will be described in detail.

The pliers (1) of the tenth embodiment differ from the pliers of the fifth embodiment in that the pivotal handle (4) is provided with a toothed pivotal handle cam (4 at), which is positioned on the pivotal handle adjacent the pivot handle pin (6) such that when the pivotal handle is pivoted on the pivot handle pin, the cam pivots about the axis of the pivot handle pin. In this embodiment, the toothed pivotal handle cam (4 at) does not directly engage the outer clamp surface (3*c*) of the fixed handle elongate bar (3*a*).

Instead, the teeth of the toothed pivotal handle cam (4 at) engage a toothed slip shoe (17*t*). The toothed slip shoe is slideable along the outer clamp surface 3*c*.

A further difference between the pliers (1) of the tenth embodiment and the fifth embodiment is that the pliers of the tenth embodiment are provided with an automatic locking device for locking the pliers in position.

The automatic locking device comprises teeth (22) provided on the end of the pivotal link (12) adjacent the pivotal link pivotal handle pin (12*a*) and a locking member (24). The locking member (24) is pivotally mounted on the pivotal handle (4) by a pivot pin (26). The pivot pin (26) is fixed to the pivotal handle (4) and extends through a lengthways extending slot (27) provided in the locking member (24). The locking member (24) had a thumb tab (28) for actuation by a user of the pliers (1). When the laminations are fully in place, the thumb tab (28) is the only portion of the locking member (24) that is visible.

At the end of the locking member (24) opposite the thumb tab (28), the side facing away from the pivotal handle pin 6 is provided with teeth (30) for engaging the teeth (22) on the pivotal link (12). On the other side of the locking member opposite the teeth (30), there is a recess that houses an end of a resilient member, which in this embodiment is compression spring (32). The opposite end of compression spring (32) is held in a recess provided in the pivotal handle (4). The compression spring (32) biases the locking member (24) to the operative position shown in FIGS. 17 and 18 in which it is able to automatically engage the teeth (22) provided on the end of the pivotal link (12).

In FIG. 18, the teeth (30) on the locking member (24) are shown engaging the teeth (22) on the pivotal link (12), thereby locking the jaws (2*a*, 2*b*) in the position shown. The teeth (22, 30) are shaped such that as the pivotal link (12) pivots from the position shown in FIG. 17 to the position shown in FIG. 18, they automatically engage in the manner of a ratchet. The biasing force provided by the compression spring (32) presses the teeth (30) into the teeth (22), thereby ensuring that locking engagement is maintained.

The lock can be released by pushing down (as viewed in FIG. 18) on the thumb tab (28) to cause the toothed end of the locking member (24) to pivot anticlockwise (as viewed in FIG. 18) to release the pivotal link (12) and allow free movement of the pivotal handle (4) relative to the fixed handle (3). When the thumb tab (28) is released, the toothed end of the locking member (24) is returned to the position shown in FIG. 17 so that the locking member is ready to automatically engage the teeth (22) of the pivotal link (12).

The toothed end of the locking member (24) is provided with a nose-like projection (36) that engages in a recess (38) provided in the pivotal handle (4). In FIG. 19 the projection (36) is shown engaged in the recess (38) such that the locking member is held in a withdrawn position in which it cannot engage with the pivotal link (12). Thus, the locking member (24) can be locked in a withdrawn inoperative position. This means that when desired the pliers 1 can be used without the automatic locking device.

When the user wishes to activate the automatic locking device, the thumb tab (28) is used to slide the locking member (24) outwardly with respect to the pivotal handle (4) to withdraw the projection (36) from the recess (38). Once the projection (36) is clear of the recess (38), the compression spring (32) acts against the toothed end of the locking member to move the locking member to the operative position shown in FIG. 17 in which it is ready to automatically engage the pivotal link (12).

Yet another difference between the pliers (1) of the tenth embodiment and the fifth embodiment is that the inner and outer clamp surfaces (3*b*, 3*c*) provided on the elongate bar (3*a*) are not parallel. Instead, the clamp surface (3*b*) tapers towards the clamp surface (3*c*) as the two surfaces approach the fixed jaw (2*a*). This wedge effect causes the moveable jaw cam (2*c*) to act more quickly and lock better. This also allows the jaw angle to be less likely to result in a partial closure when gripping a thin workpiece as the thinning of the elongate bar (3*a*) towards the fixed jaw (2*a*) can cancel out the effect of any rotation of the toothed pivotal handle cam 4 at against the toothed shoe (17).

Although the presently preferred embodiments have been described with some particularity, it is to be understood that other embodiments may be made without departing from the spirit and scope of the invention. Such embodiments and variations are considered to be within the purview and scope of the invention and the appended claims. For example the present invention could be advantageously applied to the clamping and locking mechanism of Bar Clamps used in such fields as carpentry.

The invention claimed is:

1. A hand operated gripping tool comprising:

a movable jaw, a fixed jaw, a first cam associated with said movable jaw and operating on a first surface, a pivotal handle connected with said movable jaw and a second cam associated with said pivotal handle and operating on a second surface that is spaced from said first surface, said first cam being spaced from said fixed jaw by a first variable distance, said second cam being spaced from said fixed jaw by a second variable distance and said connection of said pivotal handle with said movable jaw being such that said first distance is maintained greater than said second distance, a fixed handle associated with said fixed jaw, a pivotal link pivotally connected to said pivotal handle and said fixed handle and provided with a slide pin that is slidable in a slot defined by said fixed handle, and a locking member provided on said pivotal handle to engage said pivotal link to lock said movable jaw relative to said fixed jaw, wherein said movable and fixed jaws are cooperable to define a variable size space for receiving a workpiece, said first and second cams are operable to cause said jaws to grip said workpiece that is positioned in said variable size space, wherein said first and second cams are arranged such that rotational movement of said second cam caused by movement of said pivotal handle towards said fixed handle causes said movable jaw to pivot on said first cam to grip said workpiece that is positioned in said variable size space, and wherein said movement of said pivotal handle towards said fixed handle moves said pivotal link to positions in which it is engagable by said locking member.

2. A hand operated gripping tool as claimed in claim 1, wherein at least one of said first and second cams includes an engaging portion that enables said jaws to engage or grip and lock onto said workpiece gripped between them.

3. A hand operated gripping tool as claimed in claim 1, further comprising an elongate member fixedly connected with said fixed jaw and defining said first and second surfaces, said movable jaw being slidable along said elongate member to selectively vary the size of said variable size space and said first and second variable distances.

4. A hand operated gripping tool as claimed in claim 3, wherein said first cam and first surface are adapted to cooperate with said second cam and said second surface to lock said jaws onto said workpiece gripped between them.

5. A hand operated gripping tool as claimed in claim 4, wherein said first and second surfaces are disposed in opposed spaced apart relation and said first surface is progressively closer to said second surface as said first surface approaches said fixed jaw.

6. A hand operated gripping tool as claimed in claim 4, wherein at least one of said first and second surfaces is a substantially flat surface.

7. A hand operated gripping tool as claimed in claim 4, wherein at least one of said first and second surfaces is a toothed surface.

8. A hand operated gripping tool as claimed in claim 1 having a handle to jaw leverage ratio substantially equal to or greater than 12 to 1.

9. A hand operated gripping tool as claimed in claim 1, wherein said locking member is movable between an operative position in which it is engagable with said pivotal link and a withdrawn non-operative position in which it is not engagable by said pivotal link.

10. A hand operated gripping tool as claimed in claim 9, further comprising a biasing device arranged to bias said locking member to said operative position.

11. A hand operated gripping tool as claimed in claim 1, further comprising at least one biasing member for biasing said movable and fixed jaws towards each other.

12. A hand operated gripping tool as claimed in claim 1, wherein said locking member is provided with formations for cooperably engaging formations provided on said pivotal link.

13. A hand operated gripping tool as claimed in claim 1, further comprising at least one resilient biasing member for biasing said movable and fixed jaws to an open position.

14. A hand operated gripping tool comprising:

a movable jaw and a pivotal handle pivotally connected with said movable jaw to move said movable jaw;

a fixed jaw connected with an elongate member, said jaws defining a variable size workpiece receiving space therebetween and said movable jaw being movable along said elongate member to continuously vary the size of said workpiece receiving space between a fully open position of said jaws and a fully closed position of said jaws;

a first cam associated with said movable jaw and operating on a first surface of said elongate member;

a second cam associated with said pivotal handle and operating on a second surface of said elongate member, said second cam provided with a cam shoe and operating on said second surface via said cam shoe;

two link arms extending from said movable jaw past said elongate member, said link arms disposed in parallel spaced apart relationship to define a gap therebetween and said elongate member extending transversely of said link arms and through said gap, a fixed handle connected with said elongate member and a pivotal link that is pivotally connected to said fixed handle and said pivotal handle, said pivotal link provided with a slide pin that is slidable in a slot defined by said fixed handle, and a locking member provided on said pivotal handle to engage said pivotal link to lock said jaws, wherein said elongate member is a solid member, said first and second surfaces are flat surfaces and said elongate member extends between said first cam and said second cam with said first and second cams disposed at opposite sides of said elongate member, said pivotal handle is mounted on a pivot pin and said second cam is disposed between said pivot pin and said elongate member, said pivot pin extending through said link arms at a position adjacent respective ends of said link arms that are remote from said movable jaw and spaced from said elongate member, pivoting movement of said pivotal handle causes progressive operation of said second cam on said second surface to cause progressive operation of said first cam on said first surface that causes said movable jaw to pivot towards said fixed jaw to grip a workpiece engaged by said jaws, and said movement of said pivotal handle towards said fixed handle moves said pivotal link to positions in which it is engagable by said locking member.

15. A hand operated gripping tool as claimed in claim 14, wherein said first surface of said elongate member is defined by an outer face thereof that faces in a first direction and said second surface of said elongate member is defined by an outer face thereof that faces in a second direction that is opposite said first direction.

16. A hand operated gripping tool as claimed in claim 14, wherein said locking member is provided with formations to cooperably engage formations provided on said pivotal link.

17. A hand operated gripping tool as claimed in claim 14, further comprising at least one resilient biasing member that biases said jaws towards an open position.

18. A hand operated gripping tool as claimed in claim 14, wherein said first and second surfaces of said elongate member are disposed in opposed spaced apart relationship and said first surface is disposed progressively closer to said second surface as said first and second surfaces approach said fixed jaw.

19. A hand operated gripping tool as claimed in claim 14, wherein said first cam is spaced from said fixed jaw by a first variable distance, said second cam being spaced from said fixed jaw by a second variable distance and said pivotal connection of said pivotal handle with said movable jaw is such that said first distance is maintained greater than said second distance.

* * * * *

UNITED STATES PATENT AND TRADEMARK OFFICE

CERTIFICATE OF CORRECTION

PATENT NO. : 8,677,865 B2
APPLICATION NO. : 13/155850
DATED : March 25, 2014
INVENTOR(S) : Nigel A. Buchanan et al.

It is certified that error appears in the above-identified patent and that said Letters Patent is hereby corrected as shown below:

In the Specification

Column 4
Line 47, “atm” should be --arm--

Column 5
Line 35, “operate” should be --operates--
Line 52, Delete “1” after “fastener”

Column 6
Line 26, “(4 at)” should be --(4at)--
Line 27, “(act)” should be --(3ct)--

Column 8
Line 23, “(50” should be --(5f)--
Line 59, “(oat)” should be --(4at)--
Line 60, “earn” should be --cam--

Column 9
Line 23, “(4 at)” should be --(4at)--
Line 27, “(4 at)” should be --(4at)--
Line 30, “(4 at)” should be --(4at)--

Column 10
Line 40, “4 at” should be --4at--

Signed and Sealed this
Thirtieth Day of June, 2015

Michelle K. Lee

Michelle K. Lee
*Director of the United States Patent and Trademark Office*